US008298005B2

(12) United States Patent
Annequin

(10) Patent No.: US 8,298,005 B2
(45) Date of Patent: Oct. 30, 2012

(54) FIXED COAXIAL CONNECTOR

(75) Inventor: Sébastien Annequin, Voiron (FR)

(73) Assignee: Raydiall, Rosny-Sous-Bois (FR)

( * ) Notice: Subject to any disclaimer, the term of this patent is extended or adjusted under 35 U.S.C. 154(b) by 148 days.

(21) Appl. No.: 12/905,457

(22) Filed: Oct. 15, 2010

(65) Prior Publication Data

US 2011/0092095 A1 Apr. 21, 2011

(30) Foreign Application Priority Data

Oct. 20, 2009 (FR) ..... 09 57332

(51) Int. Cl.
*H01R 9/05* (2006.01)

(52) U.S. Cl. ..... 439/578; 439/581; 439/63

(58) Field of Classification Search ..... 439/581, 439/63, 578, 357
See application file for complete search history.

(56) References Cited

U.S. PATENT DOCUMENTS 6,776,621 B1 * 8/2004 Dye ..... 439/63
7,101,185 B2 9/2006 Budra et al.
7,101,189 B1 9/2006 Huss et al.
7,326,063 B1 * 2/2008 Raudenbush et al. ..... 439/63
7,563,103 B1 * 7/2009 Hall et al. ..... 439/63
7,749,020 B1 * 7/2010 Chang ..... 439/567

FOREIGN PATENT DOCUMENTS

EP 1 755 200 A2 2/2007
WO WO 99/62140 A2 12/1999
WO WO 2009/074262 A1 6/2009

OTHER PUBLICATIONS

French Search Report for Corresponding French Application No. 0957332, dated Jun. 3, 2010 (w/ English translation).

* cited by examiner

*Primary Examiner* — Hae Moon Hyeon
(74) *Attorney, Agent, or Firm* — Oliff & Berridge, PLC

(57) ABSTRACT

The present invention provides a coaxial connector element comprising:

a body defining at least part of the outside surface of the connector element and carrying mechanical coding means of the connector element;

a ground contact placed inside the body;

an insert including a portion defining an insulator; and a central contact mounted inside the ground contact with the insulation interposed therebetween;

wherein the body and the ground contact are made as a single part and by the fact that the insert includes a locking portion.

19 Claims, 5 Drawing Sheets

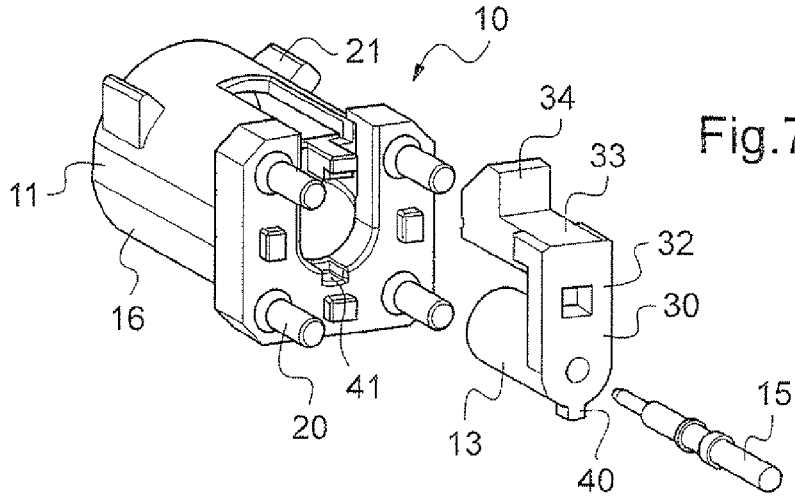
Fig.7
Fig.8
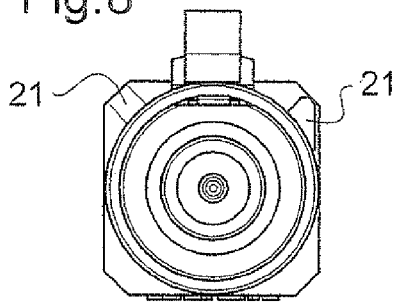
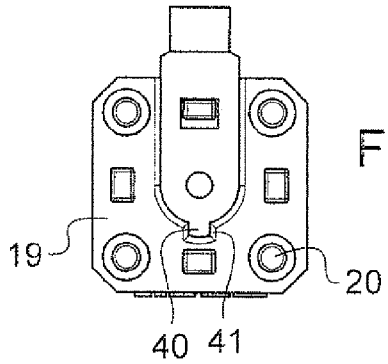
Fig.9
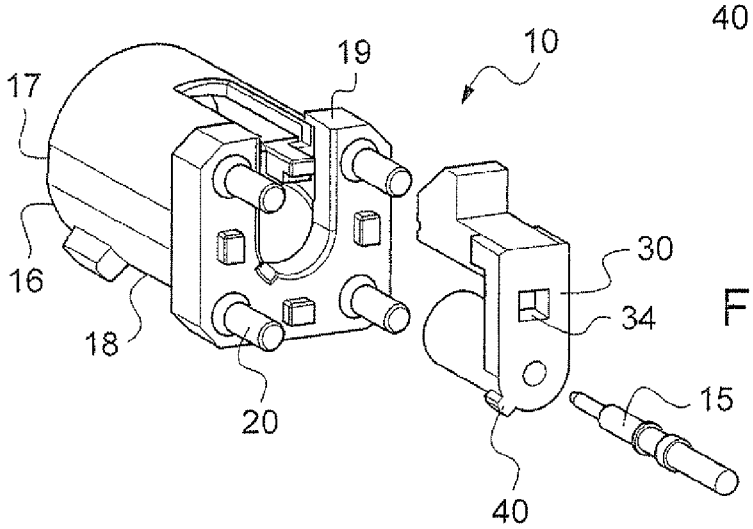
Fig.10
Fig.11
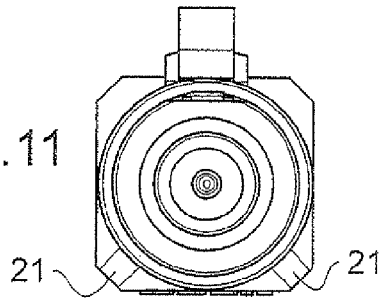
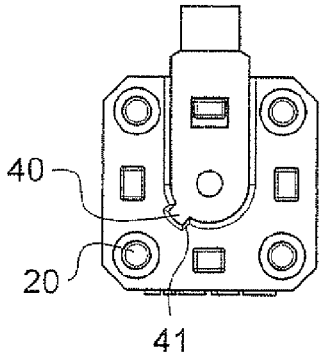
Fig.12

FIXED COAXIAL CONNECTOR

FIELD OF THE INVENTION

The present invention relates to a coaxial connector element.

The invention relates more particularly to a (snap-fastening) SubMiniature version B (SMB) type coaxial connector element made in accordance with the Fachnormenausschuss Kraftfahrzeugindustrie (FAKRA) standardization scheme (Automobile Industry Standards Commission).

BACKGROUND OF THE INVENTION

In the meaning of the invention, the term "coaxial connector element in accordance with a FAKRA standardization scheme" means a coaxial connector element having a body of mechanical dimensions in an axial section of said body cooperating with the body of a complementary connector element in order to establish a mechanical link between the two bodies that are as defined in the DIN 72594-1 standard.

Such connector elements are generally used in the automobile field for data transmission cables.

FIG. 1 shows a known example of a coaxial connector element 1, in particular for the automobile field. As shown, the coaxial connector element 1 extends along a longitudinal axis X and has a body 2 defining the outside surface of the connector and carrying a locking nose 6. The body 2 receives a ground contact 3, and a central contact 4 is received inside the ground contact 3 via insulation 5. Such a connector element 1 is constituted by four distinct parts and assembling those parts together is lengthy and expensive.

Application WO 2009/074262 discloses a coaxial connector element in accordance with the FAKRA standardization scheme in which the insulation and the body are made as a single part by injecting a dielectric material. With such a connector element, the ground contact is a metal part distinct from the body, which is made of plastics material. The use of two distinct parts for making the body and the ground contact can give rise to coaxiality problems.

U.S. Pat. No. 7,101,189 discloses a coaxial connector comprising a central received inside a body made of metal with an insulator interposed therebetween.

The body comprises a locking portion that does not belong to the insert.

There exists a need to benefit from a coaxial connector element that is simple and inexpensive to fabricate, while presenting satisfactory coaxiality between the ground contact and the body.

OBJECT AND SUMMARY OF THE INVENTION

An object of the invention is to satisfy this need, and in exemplary embodiments this object is achieved by a coaxial connector element comprising:

- a body defining at least part of the outside surface of the connector element and carrying mechanical coding means of the connector element;
- a ground contact placed inside the body;
- an insert including a portion defining an insulator; and
- a central contact mounted inside the ground contact with the insulator interposed therebetween;

wherein the body and the ground contact are made as a single part and by the fact that the insert includes a locking portion.

Such a connector element presents a small number of distinct parts compared with the connector shown in FIG. 1, thereby reducing the number of assembly operations. Furthermore, with such a connector element, the ground contact and the body are made as a single part, thereby making it possible to ensure a high degree of coaxiality between them and ensuring that the complementary connector element is properly guided during coupling.

The body may include a tubular portion extending along a longitudinal axis, and the front longitudinal end of the tubular portion may be open and defines a connection face for connection with a complementary connector element.

In the meaning of the invention, the term "front of the connector element" designates the portion thereof close to the connection face, and the term "rear of the connection element" designates the portion thereof close to the end of the connector element that is opposite from its connection face.

The connection face may present mechanical dimensions that correspond to the FAKRA standardization scheme. Such a connector element satisfies dimensional and electrical quality requirements and is interchangeable.

The locking portion may carry a locking nose, said portion extending parallel to the axis of the tubular portion of the body, and a link portion connecting a longitudinal end of the insulator to a longitudinal end of the portion carrying the locking nose, said link portion extending transversely, in particular perpendicularly, to the axis along which the insulator extends. According to the invention, the insulation and the locking nose are advantageously combined in an insert that is made of a material that is different from the material of the body, unlike the disclosure of WO 2009/074262.

The insert may be made as a single part, which means that the locking part and the insulator may belong to a single piece.

The wall of the tubular portion of the body may include at least one aperture and the portion carrying the locking nose may be received in said aperture. The portion carrying the locking nose may thus define a fraction of the outside surface of the connector element.

The mechanical coding means may be one or more portions in relief projecting outwards from the tubular portion of the body. For example, each type of connector element may be associated with specific mechanical coding means, so that two connector elements of different types differ in the number of portions in relief, in their dimensions, or indeed in their angular positions around the tubular portion of the body, for example. These mechanical coding means may be as defined in the DIN 72594-1 standard, for example.

The mechanical coding means serve to identify the type of connector element and to ensure that it couples with a complementary connector element that is of the same type.

The portion carrying the locking nose may include a front wall that comes into abutment against a wall of the aperture, the front wall of the portion carrying the locking nose possibly including a groove and the corresponding wall of the aperture being chamfered in part so that the chamfer is received in the groove when the locking nose is in abutment against the wall of the aperture. Such an abutment system may prevent the locking nose from lifting or folding under traction, stresses when the insert is in contact with the body.

The wall of a cavity of the body and the outside surface of the insert may include keying means that co-operate when the insert is in contact with the body. By way of example, the keying means may comprise one or more lugs carried by the insulator and one or more grooves formed in the wall of said cavity. The angular position of the groove in the wall of the cavity may, for example, be determined as a function of the angular position of the mechanical coding means carried by the outside surface of the tubular portion.

Similarly, the angular position on the insulator of the lug may be determined as a function of the angular position of the mechanical coding means carried by the outside surface of the tubular portion of the body with which the insert is in contact. By way of example, a particular angular position for the mechanical coding means may correspond to a specific angular position of the groove and of the lug so as to ensure that the insert in contact with the body does indeed match said body. This mechanical keying acts in addition to the color coding conventionally used for the insert (or for the body).

In first exemplary embodiments of the invention, the connector element is straight.

The body and the ground contact may be made of metal, thereby enabling the connection face of the connector element to be reinforced relative to connector elements in which said connector face is defined by a portion of the body made of plastics material. With a body made of metal, coupling with a complementary connector element that does not present matching mechanical coding means does not cause said connection face to be deformed. In this example, the insert is fitted on the body.

The body advantageously includes a base extending transversely, in particular perpendicularly, relative to the axis of said tubular portion, said base presenting:

a first face in contact with the rear longitudinal end of the tubular portion; and a second face defining a rear face of the connector element.

By way of example, such a base may serve to fasten the connector element on a connection plate, e.g. a printed circuit board (PCB).

The base may include a cavity communicating with the aperture formed in the wall of the tubular portion, with the link portion and the longitudinal ends connected to the link portion of the insulator and the portion carrying the locking nose being received in said cavity. The presence of such a cavity enables the insert to be mounted on the body from the rear of the connector element, i.e. in the embodiment described, from the end thereof that is defined by the base.

In a variant, the body, the ground contact, and the insert are made by bi-injection of plastics materials, the plastics material defining the body and the ground contact being metallized. Still in this variant, the insert may be molded onto the body and the ground contact.

When the insert is made of plastics materials, a coloring agent may be used so that the insert has a color specific to a given use.

The tubular portion may include a closed rear longitudinal end defining a rear face of the connector element. By way of example, said rear longitudinal end serves to provide electrical and mechanical connection with a connection plate, e.g. a printed circuit board.

The rear longitudinal end of the tubular portion of the body may include a cavity communicating with the aperture formed in the wall of said tubular portion, and the link portion of the part together with the longitudinal ends connected to said link portion of the insulation and the portion carrying the locking nose may be received in said cavity. The rear longitudinal end of the tubular portion of the body may include at least one slot that is distinct from the cavity. By way of example, this rear end includes a plurality of slots extending at the same radial distance from the longitudinal axis of the tubular portion of the body, for example, with two adjacent slots being separated by a bridge of material.

In other exemplary embodiments of the invention, the coaxial connector element is angled.

The body and the ground contact of an angled connector element may be made by injection-molding metal.

In a variant, the body, the ground contact, and the insert of an angled connector element are made by bi-injection of plastics materials, the plastics material defining the body and the ground contact being metallized.

The connector element may include a rear end for connecting electrically and mechanically to a connection plate, e.g. a printed circuit board.

The central contact of such an angled connector element may present an angled shape and it may be made as a single part.

The above-described connector element may constitute a plug or a receptacle.

BRIEF DESCRIPTION OF THE DRAWINGS

Other advantages properties and characteristics of the invention appear on reading the following description of non-limiting embodiments of the invention and on examining the accompanying drawings, in which:

FIGS. 7 to 12 show two examples of keying means provided between the insert and the body;

MORE DETAILED DESCRIPTION

Figure 1:
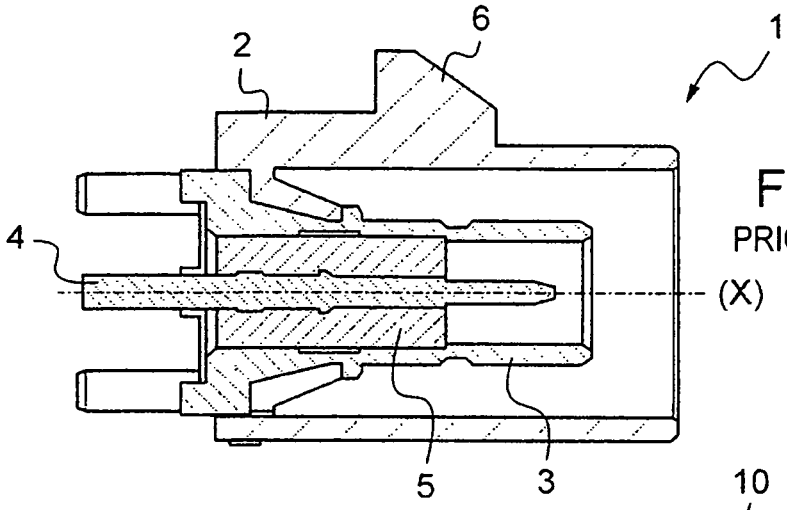
Fig.1 PRIOR ART
FIG. 1 shows a known connector element.
Figure 2:
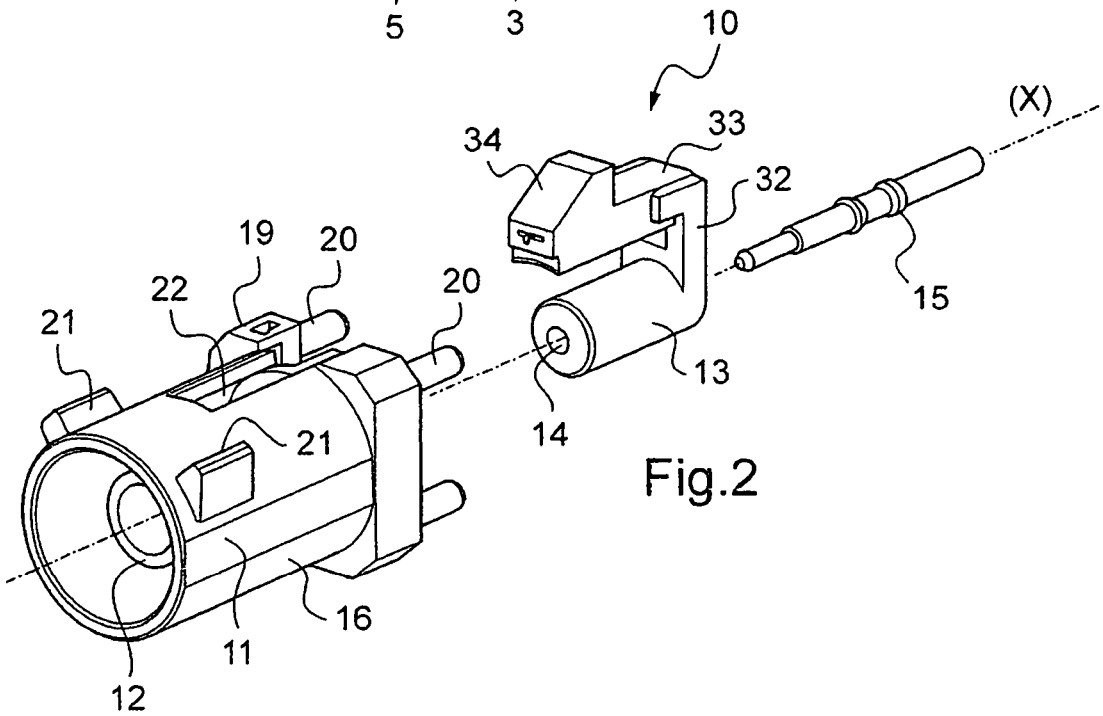
FIGS. 2 and 3 are perspective exploded views from the front and front the rear showing a connector element in a first embodiment of the invention.

FIG. 2 shows a coaxial connector element 10 in the first embodiment of the invention. This connector element 10 is shown from the front in FIG. 2 and from the rear in FIG. 3, and it presents an axis X.

Figure 3:
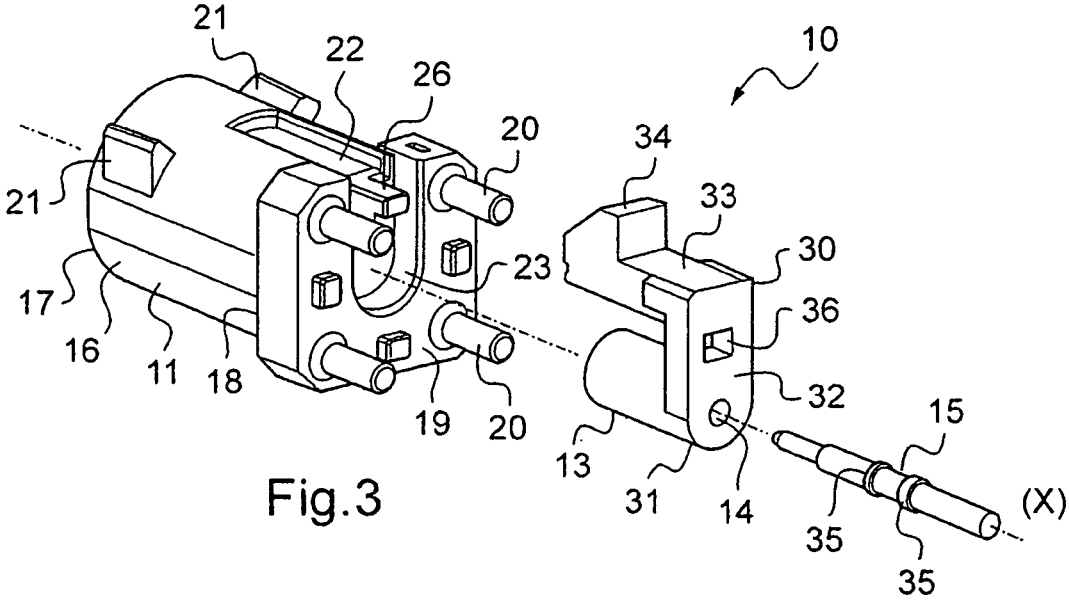

As can be seen in FIGS. 2 and 3, the connector element 10 comprises a body 11, a ground contact 12 located inside the body 11, an insulator 13 of tubular shape designed to be received inside the ground contact 12, a cavity 14 being provided inside the insulator 13 to receive a central contact 15.

Figure 4:
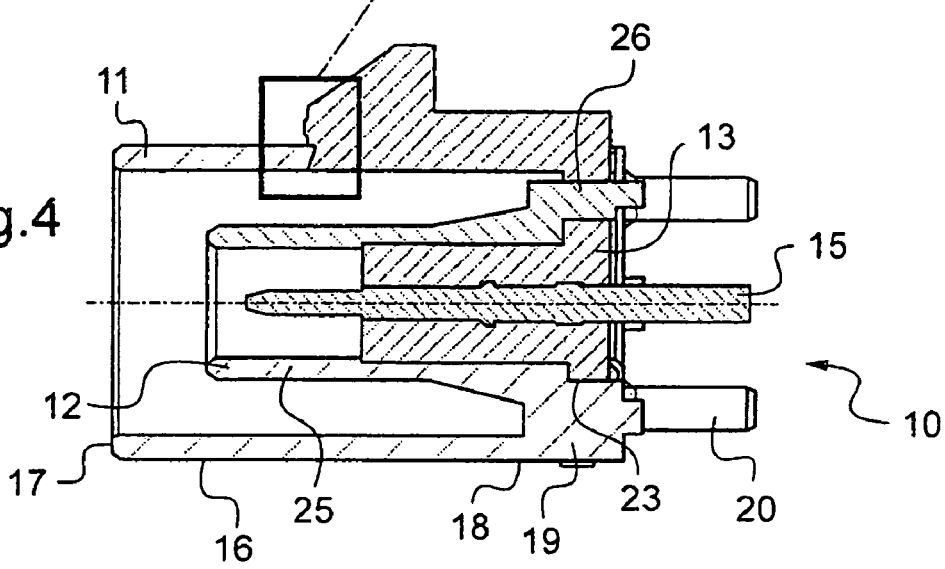
FIG. 4 is a longitudinal section view of the connector element shown in FIGS. 2 and 3.

As can be seen in FIGS. 2 to 4, the body 11 extends longitudinally along the axis X and may include a tubular portion 16 extending around the axis X. This tubular portion presents a front longitudinal end 17 and a rear longitudinal end 18.

The front longitudinal end 17 in the example shown is open and defines a connection face with a complementary connector element. The rear longitudinal end 18 is connected to a base 19 extending perpendicularly to the axis X and carrying studs 20 serving in particular to make a mechanical connection with a connection plate, e.g. a printed circuit board.

As can be seen in FIGS. 2 to 4, in the proximity of its front longitudinal end 17, the tubular portion 16 has mechanical coding means 21 constituted by portions in relief projecting towards the outside of the body 11. In the example shown, two projecting portions in relief 21 are carried by the tubular portion 16, however the invention is not limited to any particular number of such portions in relief.

These portions in relief 21 may be standardized, e.g. extending parallel to the axis X of the tubular portion 16 and they may be placed at the same distance from the connection face defined by the front longitudinal end 17.

As shown in FIGS. 2 to 4, the tubular portion 16 includes an aperture 22 extending from the rear longitudinal end 18 of the tubular portion 16 over less than the total length thereof. By way of example, this aperture 22 is formed through the entire thickness of the wall of the tubular portion 16.

As can be seen in FIG. 3, this aperture 22 communicates with a cavity 23 formed in the base 19. The cavity 23 extends from a central region of the base 19 towards the outside thereof, perpendicularly to the axis X of the tubular portion 16. In the example shown, the cavity 23 is formed through the entire thickness of the base 19.

As can be seen in FIG. 4, the ground contact 12 is made integrally with the body 11, the ground contact 12 comprising, for example, a hollow cylindrical portion 25 coaxial with the tubular portion 16 and connected thereto at the base 19. As can be seen in FIGS. 3 and 4, the ground contact 12 includes an overhang portion 26 at the base 19, said overhang portion 26 projecting into the cavity 23 and performing a function that is described below.

In this first embodiment of the invention, the body 11 and the ground contact 12 are made as a single metal part, e.g. by die casting an alloy of copper, aluminum, magnesium, and where appropriate zinc (zamak) or by metal injection molding (MIM).

As shown in FIGS. 2 to 5, the connector element 10 includes an insert 30 in contact with the body 11. In the example of FIGS. 2 to 12, the insert 30 is fitted on the body 11. The insert 30 comprises a tubular portion defining the insulator 13. The insulator 13 is connected at its rear longitudinal end 31 to a link portion 32 extending perpendicular to the axis X of the insulator 13, the link portion also being connected to a portion 33 carrying a locking nose 34, said portion 33 extending parallel to the insulator 13. As shown, the link portion 32 may include a through cavity 36 performing a function that is described below.

By way of example, the insert 30 is made by molding a plastics material through which a coloring agent may be added, and the insert may be configured to be snap-fastened, force-fitted, or crimped on the body 11.

By way of example, the central contact 15 is made by machining using the cut-and-roll technique or indeed it may be machined and then have the insulator 13 molded thereon. The central contact 15 is received in the cavity 14 passing through the insulator 13 and may be held inside the cavity with barbs 35 or it may be molded onto the insulator 13.

Figure 6:
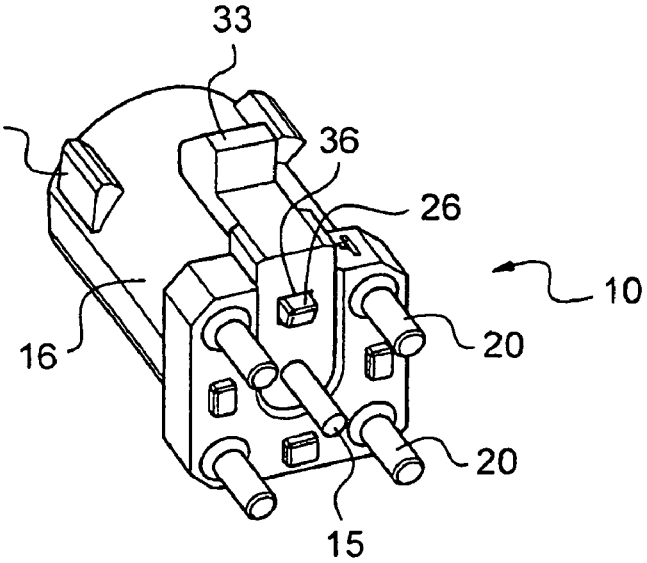
FIG. 6 shows the connector element of FIGS. 2 to 5 when the insert is fitted on the body.

When mounting the insert 30 on the body 11, the insert 30 is introduced from the rear of the connector element 10 through the cavity 23. The insulator 13 is received inside the hollow cylindrical portion 25 of the ground contact 12, while the link portion 32 is received in the cavity 23 and the portion 33 carrying the locking nose 34 rests in the aperture 22, defining a portion of the outside surface of the connector element 10. Once the insert 30 is in place, the overhang portion 26 is received in the through cavity 36 formed in the link portion 32, as can be seen in FIG. 6.

Figure 5:
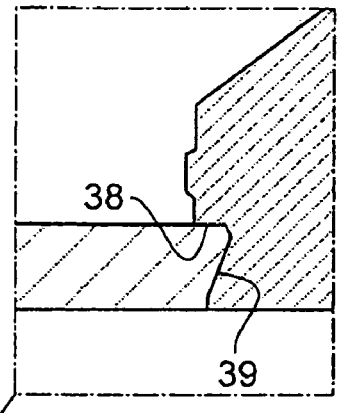
FIG. 5 shows a detail of FIG. 4.

As can be seen in FIG. 5, the locking nose 34 may include a front wall 38, and the aperture 22 may include a wall 39 for coming into contact against the front wall 38 so as to constitute an abutment system. By way of example, the wall 39 of the aperture 22 is partially chamfered and the front wall 38 of the locking nose 34 defines a groove for receiving the chamfer of the wall 39.

FIGS. 7 to 12 show examples of coaxial connector elements 10 in the first embodiment that differ from the connector elements shown in FIGS. 1 to 6 by the fact that they include a mechanical keying system for inserting the insert 30 in the body 11.

As shown in FIG. 7, the keying system may be constituted by a lug 40 carried by the insulator 13 at its rear longitudinal end and by a groove 41 formed in the wall of the cavity 23.

The angular positions of the lug 40 and of the groove 41 may be selected as a function of the type of connector element 10 of which the insert 30 forms a part. For example, the body shown in FIG. 8 has mechanical coding means 21 characteristic of type B coding, and for a coding of that type the angular position of the groove 41 relative to the axis X is as shown in FIGS. 7 and 9.

The insert 30 that is to come into contact with a body for a type B connector element may then have a lug 40 at an angular position relative to the axis X that is adapted to co-operate with the groove 41 so as to ensure that the insert 30 is indeed appropriate for a type B connector element. In addition to optionally using a color that is specific to a type of coding when making the insert 30, such a keying system may further reduce the risk of assembling together a body 11 and an insert of types that are different.

In the example of FIGS. 10 to 12, the body 11 includes mechanical coding means 21 characteristic of type K coding, and the angular positions of the mechanical coding means 21 and also of the groove 41 relative to the axis X are different from those described with reference to FIGS. 7 to 9. Thus, the insert 30 of FIG. 6 cannot be inserted in the cavity 23 of the body 11 shown in FIG. 10 because its lug 40 is in an angular position that is different from that of the groove 41. An insert that is suitable for such insertion is shown in FIGS. 10 and 12.

Figure 13:
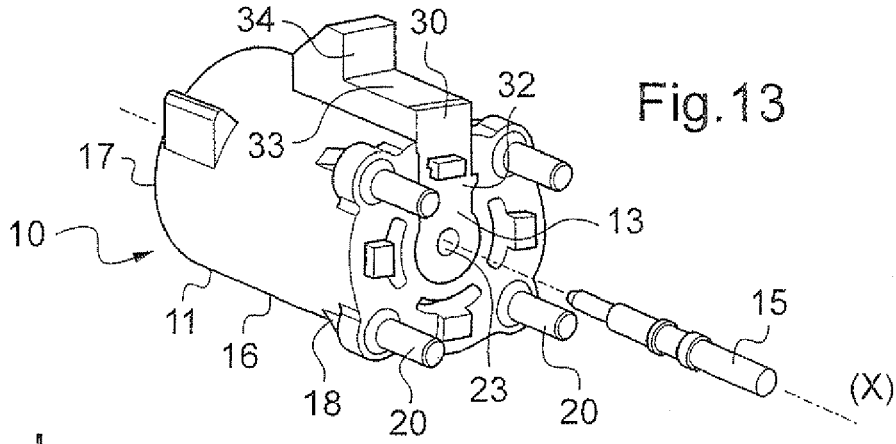
FIG. 13 is a perspective and exploded view from the rear of a connector element in a second embodiment of the invention.

With reference to FIG. 13 there follows a description of a coaxial connector element 10 in a second embodiment of the invention.

Similarly to that described with reference to FIGS. 2 to 12, the body 11 and the ground contact 12 are made as a single part, the body 11 having a tubular portion 16 with its front longitudinal end 17 open and defined by a connection face. Contrary to the above-described example, the body 11, the ground contact 12, and the insert 30 are made by bi-injection of plastics materials. In a variant, the insert 30 is molded onto the body 11 and onto the ground contact 12. By way of example, the insert 30 is made of a non-metallizable plastics material with a coloring agent, in particular a polyamide filled with glass fibers. The body 11 and the ground contact 12 are made of a metallizable plastics material, e.g. a polyamide filled with glass fibers having metal additives. The inside and/or outside surfaces of the hollow cylindrical portion 25 of the ground contact 12 are metallized, for example. Such a connector element 10 may advantageously be light in weight.

As can be seen in FIGS. 13 to 16, the rear longitudinal end 18 of the tubular portion 16 may be closed with the exception of a cavity 23 formed therein, similar to the cavity 23 formed in the base 19 described with reference to FIGS. 2 to 12.

A plurality of slots 45 are formed in the rear longitudinal end 18, these slots 45 being situated for example on a common radius of the tubular portion 12 and not communicating with the cavity 23. Two adjacent slots 45 may be separated by a bridge of material 48.

Figure 14:
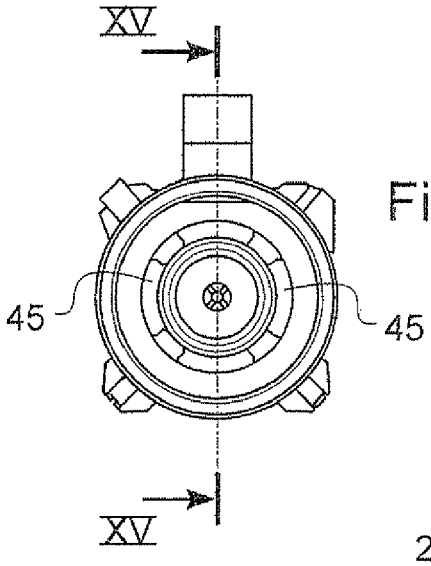
FIGS. 14 and 16 are respectively front and rear face views of the connector element of FIG. 13.
Figure 15:
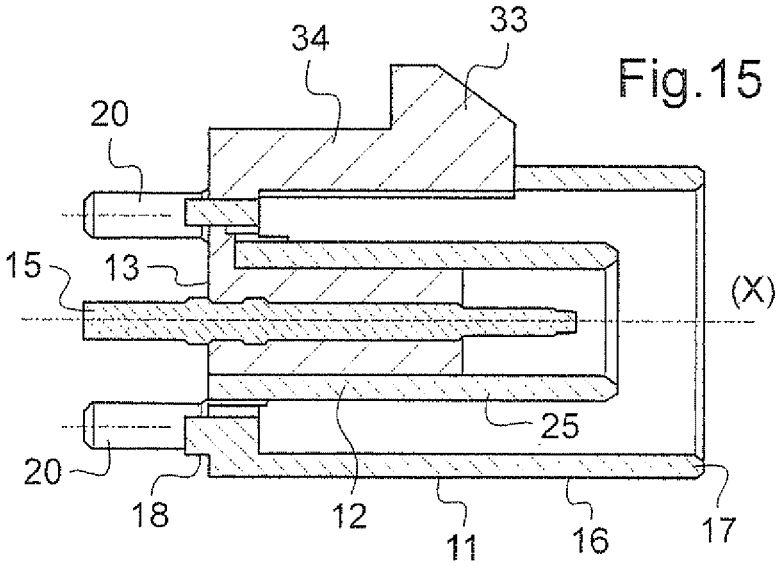
FIG. 15 is a section view on XVI-XVI of FIG. 14.
Figure 16:
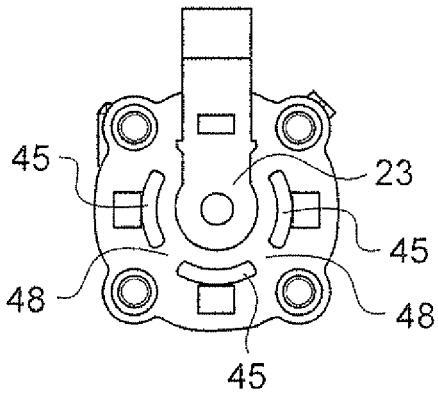

As can be seen in FIG. 14, these slots 45 are provided through the entire thickness of the rear end 18 of the tubular portion 16 so that it is possible to see through the body 11 when looking along the axis X. The rear end 18 of the tubular portion may also include studs 20 similar to those described with reference to FIGS. 2 to 12.

A connector element of the second embodiment of the invention as described with reference to FIGS. 13 to 16 may include an abutment system constituted by a front wall of the locking nose and a front wall of the aperture, as described with reference to FIG. 5.

A connector element of the second embodiment may include a mechanical keying system as described with reference to FIGS. 7 to 12.

Figure 17:
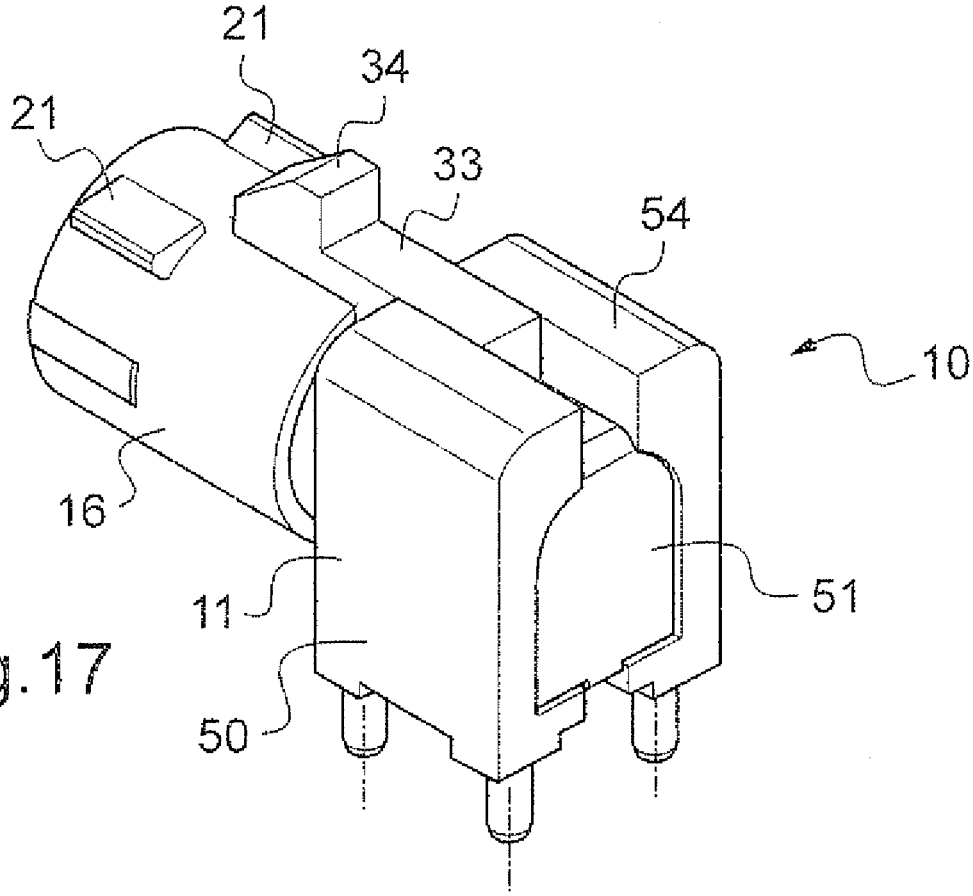
FIG. 17 is a perspective view from the rear of a connector element in a third embodiment of the invention.
Figure 18:
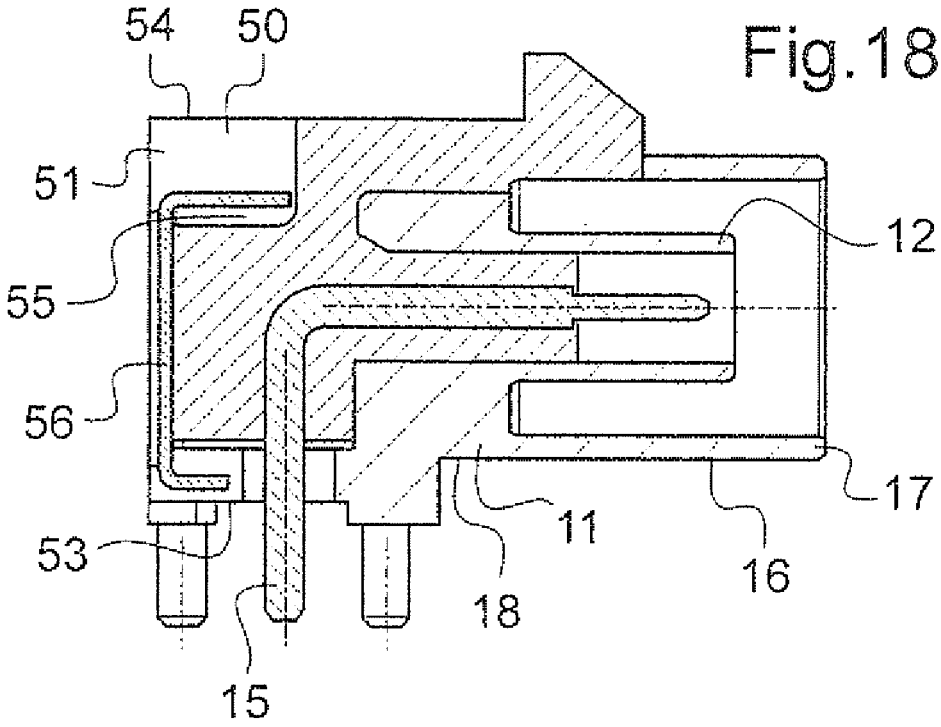
FIG. 18 is an axial section view of the FIG. 17 connector element.

There follows a description with reference to FIGS. 17 and 18 of a connector element in a third embodiment of the invention.

Unlike the connector element described with reference to FIGS. 2 to 16, which are straight connector elements, the connector element 10 of FIGS. 17 and 18 is an angled connector element.

By way of example, the body 11 is made as a single metal part together with the ground contact 12, similar to that which is described with reference to FIGS. 2 to 12. In a variant, the body 11, the ground contact 12, and the insert 30 are made by bi-injection of plastics materials, the plastics material defining the body 11 and the ground contact 12 being metallized, as described with reference to FIGS. 13 to 16.

In the example described, the body 11 comprises a tubular portion 16 similar to that described with reference to FIGS. 1 to 11 and extending along a longitudinal axis X, the tubular portion being connected at its rear longitudinal end 18 to a housing 50 extending parallel to the axis X of the tubular portion of the body 11 and presenting a section that is rectangular. The housing 50 has a rear end 51 opposite from the end 52 along the axis X, whereby it is connected to the rear end 18 of the tubular portion, and a bottom face 53 defining the rear end of the body 11.

As can be seen in FIG. 18, a cavity 55 is formed over the entire length of the housing 50, said cavity extending, when the housing is being in a section plane perpendicular to the longitudinal axis X, in a central zone and opening out to the outside via the bottom face 53 of the housing 50 to pass the central contact 15, e.g. a one-piece angled central contact, and also opening to the outside via the top face 54 of the housing 50.

When the insert 30 is to be fitted on the body 11, the insert is inserted from the rear longitudinal end 51 of the housing 50 and is then moved in the cavity 55 until it comes into abutment in the aperture 22.

Once the insert 30 is in contact with the body 11, a cap 56 cut out from a sheet of metal may be arranged to close the cavity 55 at the rear longitudinal end 51 of the housing 50. Where appropriate, the cap 56 may contribute to holding the insert 33 in place on the body 11 and to closing the electrical line.

A connector element of the third embodiment of the invention as described with reference to FIGS. 17 and 18 may include an abutment system constituted by a front wall of the locking nose and a front wall of the aperture, as described with reference to FIG. 5.

A connector element of the third embodiment may include a mechanical keying system as described with reference to FIGS. 7 to 12.

The above-described connector element 10 may constitute plugs or receptacles.

In the examples described above, the connector elements are configured to be connected electrically and mechanically to a connection plate, however the invention is not limited to such an example.

In the examples described above, the connector element presents an interface having an impedance of 50 ohms (Ω), however the invention is not limited to any particular value of impedance.

The term "comprising a" should be understood as being synonymous with the term "comprising at least one" except when specified to the contrary.

The invention claimed is:

1. A coaxial connector element comprising:

a body defining at least part of the outside surface of the connector element and carrying at least one mechanical coding portion of the connector element;

a ground contact placed inside the body; and a central contact mounted inside the ground contact with an insulator interposed therebetween;

wherein the body and the ground contact are made as a single part and wherein the connector element comprises an insert made as a single part and comprising a portion defining the insulator and a locking portion.

2. The coaxial connector element according to claim 1, wherein the body comprises a tubular portion extending along a longitudinal axis and having a front longitudinal end that is open and that defines a connection face for connection with a complementary connector element.

3. The coaxial connector element according to claim 2, wherein the connection face presents mechanical dimensions corresponding to the FAKRA standardization scheme.

4. The coaxial connector element according to claim 2, wherein the locking portion carries a locking nose, said locking portion extending parallel to the axis of the tubular portion of the body, and a link portion connecting a longitudinal end of the insulator to a longitudinal end of the locking portion carrying the locking nose, said link portion extending transversely to said longitudinal axis.

5. The coaxial connector element according to claim 4, wherein the wall of the tubular portion of the body includes at least one aperture and wherein the locking portion carrying the locking nose is received in said aperture.

6. The coaxial connector element according to claim 5, wherein the locking portion carrying the locking nose includes a front wall coming into abutment against a wall of the aperture, the front wall including a groove and the corresponding wall of the aperture being partially chamfered so that the chamfer is received in the groove when the locking nose is in abutment against the wall of the aperture.

7. The coaxial connector element according to claim 2, wherein the mechanical coding means are portions in relief projecting outwards from the tubular portion of the body.

8. The coaxial connector element according to claim 4, wherein the body includes a base extending transversely relative to the axis of the tubular portion, said base presenting:

a front face in contact with the rear longitudinal end of the tubular portion; and a rear face defining the rear end of the connector element.

9. The coaxial connector element according to claim 8, wherein the base includes a cavity communicating with the aperture formed in the wall of the tubular portion, the link portion and the longitudinal ends of the insulator and of the locking portion carrying the locking nose to which the link portion is connected being received in said cavity.

10. The coaxial connector element according to claim 4, wherein the tubular portion has a closed rear longitudinal end defining a rear face of the connector element.

11. The coaxial connector element according to claim 10, wherein the rear end of the tubular portion of the body includes a cavity communicating with the aperture formed in the wall of said tubular portion, the link portion and the longitudinal ends of the insulator and of the locking portion carrying the locking nose to which the link portion is connected being received in said cavity.

12. The coaxial connector element according to claim 11, wherein the rear end of the tubular portion of the body includes at least one slot distinct from the cavity.

13. The coaxial connector element according to claim 1, wherein the wall of a cavity of the body and the outside surface of the insert include a keying system including portions that co-operate when the insert is in contact with the body.

14. The coaxial connector element according to claim 1, the coaxial connector element being a straight connector element.

15. The coaxial connector element according to claim 14, wherein the body and the ground contact are made of metal.

16. The coaxial connector element according to claim 14, wherein the body, the ground contact, and the insert are made by bi-injection of plastics materials, the plastics material defining the body and the ground contact being metallized.

17. The coaxial connector element according to claim 1, the coaxial connector element being angled.

18. The coaxial connector element according to claim 17, wherein the body, the ground contact, and the insert are made by bi-injection of plastics materials, the plastics material defining the body and the ground contact being metallized.

19. The coaxial connector element according to claim 1, wherein the coaxial connector element constitutes a plug or a receptacle.

* * * * *